US009926715B1

(12) United States Patent
Morrison

(10) Patent No.: US 9,926,715 B1
(45) Date of Patent: Mar. 27, 2018

(54) DEPLOYABLE SHELTERING ASSEMBLY

(71) Applicant: James Morrison, Black Hawk, CO (US)

(72) Inventor: James Morrison, Black Hawk, CO (US)

( * ) Notice: Subject to any disclaimer, the term of this patent is extended or adjusted under 35 U.S.C. 154(b) by 0 days.

(21) Appl. No.: 15/451,660

(22) Filed: Mar. 7, 2017

(51) Int. Cl.
*E04H 6/04* (2006.01)
*E04H 6/02* (2006.01)
*E04H 15/06* (2006.01)

(52) U.S. Cl.
CPC ..... *E04H 6/04* (2013.01); *E04H 6/025* (2013.01); *E04H 15/06* (2013.01)

(58) Field of Classification Search
CPC . E04H 6/04; E04H 6/025; E04H 15/06; B60J 11/00
USPC ..... 135/88.06
See application file for complete search history.

(56) References Cited

U.S. PATENT DOCUMENTS 2,989,967 A * 6/1961 Lee ..... E04H 15/06 135/120.3
4,605,030 A 8/1986 Johnson
4,655,236 A 4/1987 Dorame et al.
4,944,321 A * 7/1990 Moyet-Ortiz ..... B60J 11/00 135/148
5,241,977 A 9/1993 Flores et al.
5,575,300 A 11/1996 James
5,579,796 A 12/1996 Mallo et al.
D403,782 S 1/1999 James
7,172,234 B2 2/2007 Chang
7,546,844 B2 6/2009 Al-Mutairi
7,946,306 B2 5/2011 Ampoyo
8,453,996 B1 * 6/2013 Papadopoli ..... A01G 1/08 135/88.06
8,607,810 B1 * 12/2013 Chung ..... E04H 6/04 135/88.06
9,010,348 B1 * 4/2015 Kite ..... E04H 6/04 135/88.06
2008/0053504 A1 * 3/2008 Al-Mutairi ..... E04H 6/025 135/88.06

FOREIGN PATENT DOCUMENTS

WO WO2008028109 3/2008

* cited by examiner

*Primary Examiner* — Noah Chandler Hawk

(57) ABSTRACT

A deployable sheltering assembly for a vehicle includes a set of four supports and a panel, which is flexible. Each support comprises a rod that is coupled to and extends perpendicularly from a plate. The rod comprises a plurality of nested sections and is selectively extensible. The rod is configured to extend from the plate adjacent to a side of the vehicle. A first coupler is coupled to a top of the rod. Each of a set of four second couplers is coupled proximate to a respective corner of the panel. The plates are configured to position singly under the wheels of the vehicle. The supports are positioned singly proximate to each wheel of the vehicle. Each second coupler is positioned to couple to a respective first coupler to couple the panel to the supports so that the panel is configured to shelter the vehicle.

17 Claims, 4 Drawing Sheets

DEPLOYABLE SHELTERING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to sheltering assemblies and more particularly pertains to a new sheltering assembly for a vehicle.

BRIEF SUMMARY OF THE INVENTION

An embodiment of the disclosure meets the needs presented above by generally comprising a set of four supports and a panel, which is flexible. Each support comprises a rod that is coupled to and extends perpendicularly from a plate. The rod comprises a plurality of nested sections and is selectively extensible. The rod is configured to extend from the plate adjacent to a side of the vehicle. A first coupler is coupled to a top of the rod. Each of a set of four second couplers is coupled proximate to a respective corner of the panel. The plates are configured to position singly under the wheels of the vehicle. The supports are positioned singly proximate to each wheel of the vehicle. Each second coupler is positioned to couple to a respective first coupler to couple the panel to the supports so that the panel is configured to shelter the vehicle.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
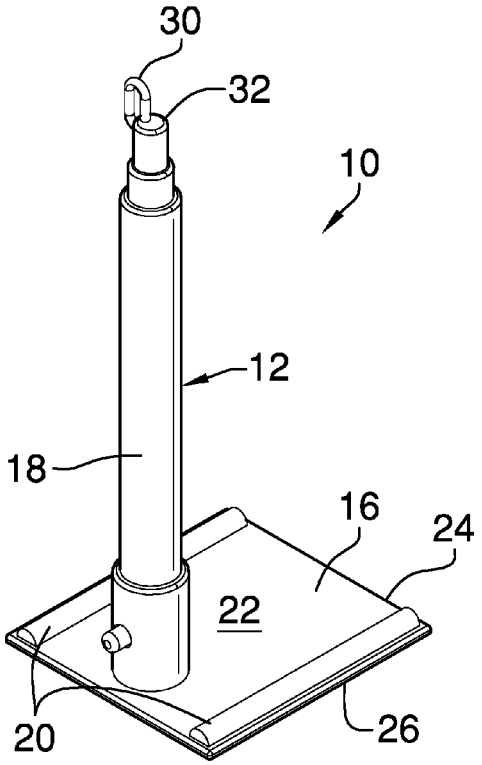
FIG. 1 is an isometric perspective view of a deployable sheltering assembly according to an embodiment of the disclosure.
Figure 2:
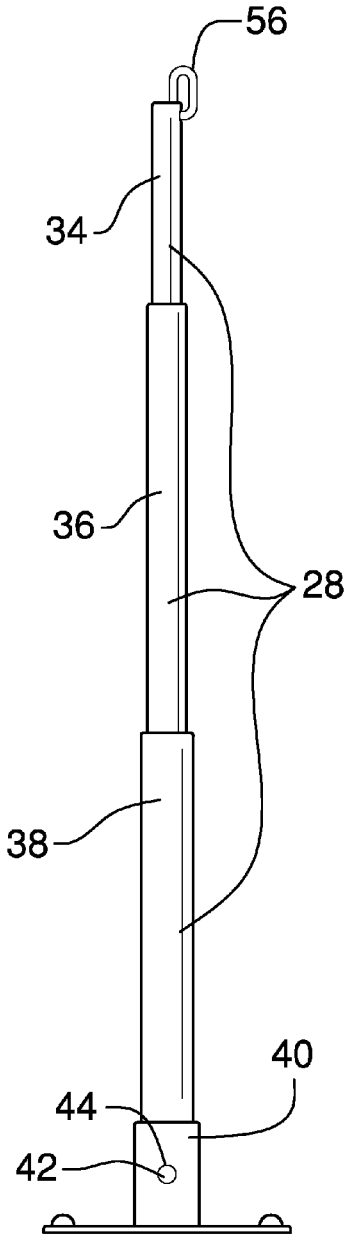
FIG. 2 is a side view of an embodiment of the disclosure.
Figure 3:
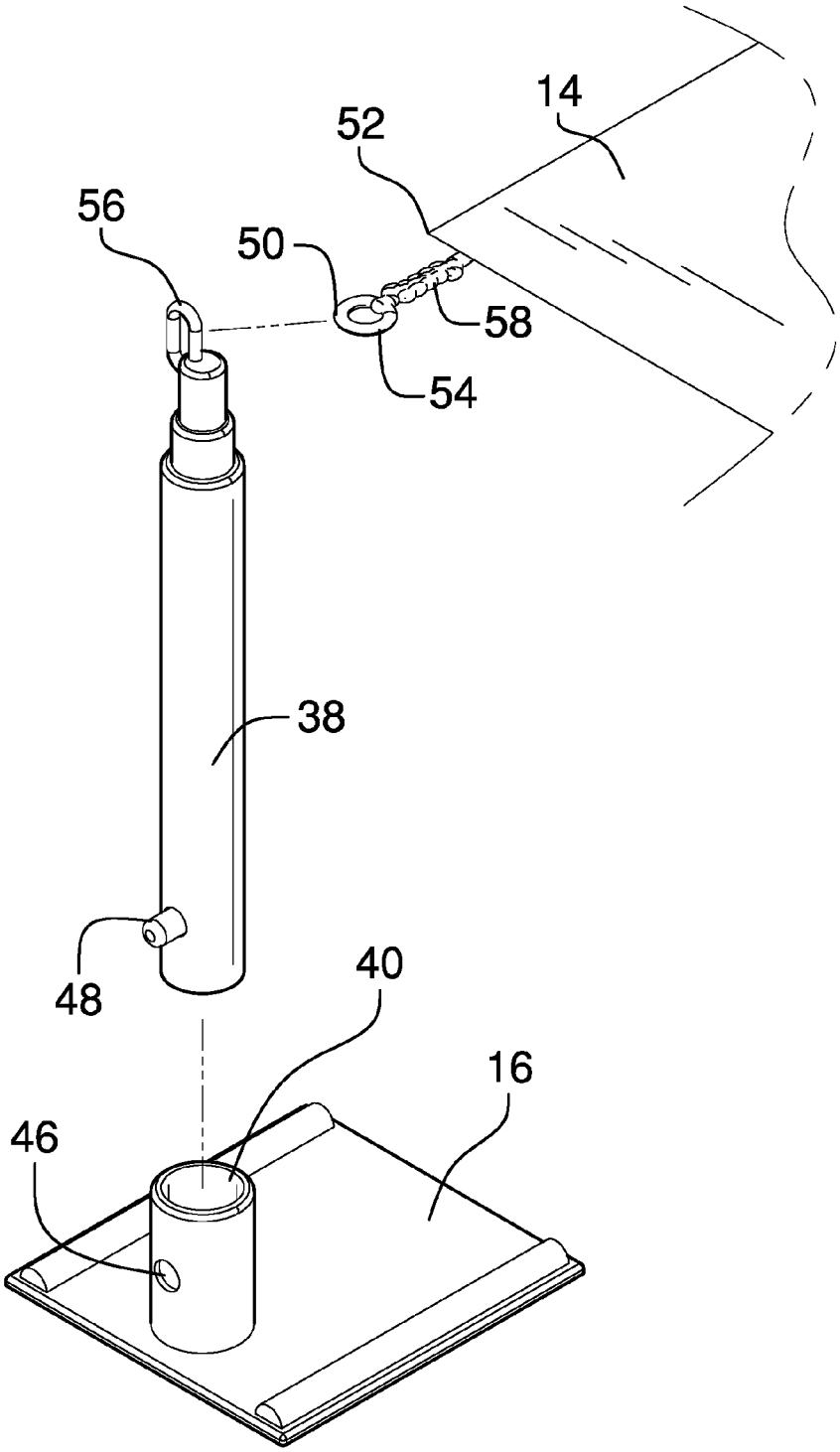
FIG. 3 is an exploded view of an embodiment of the disclosure.
Figure 4:
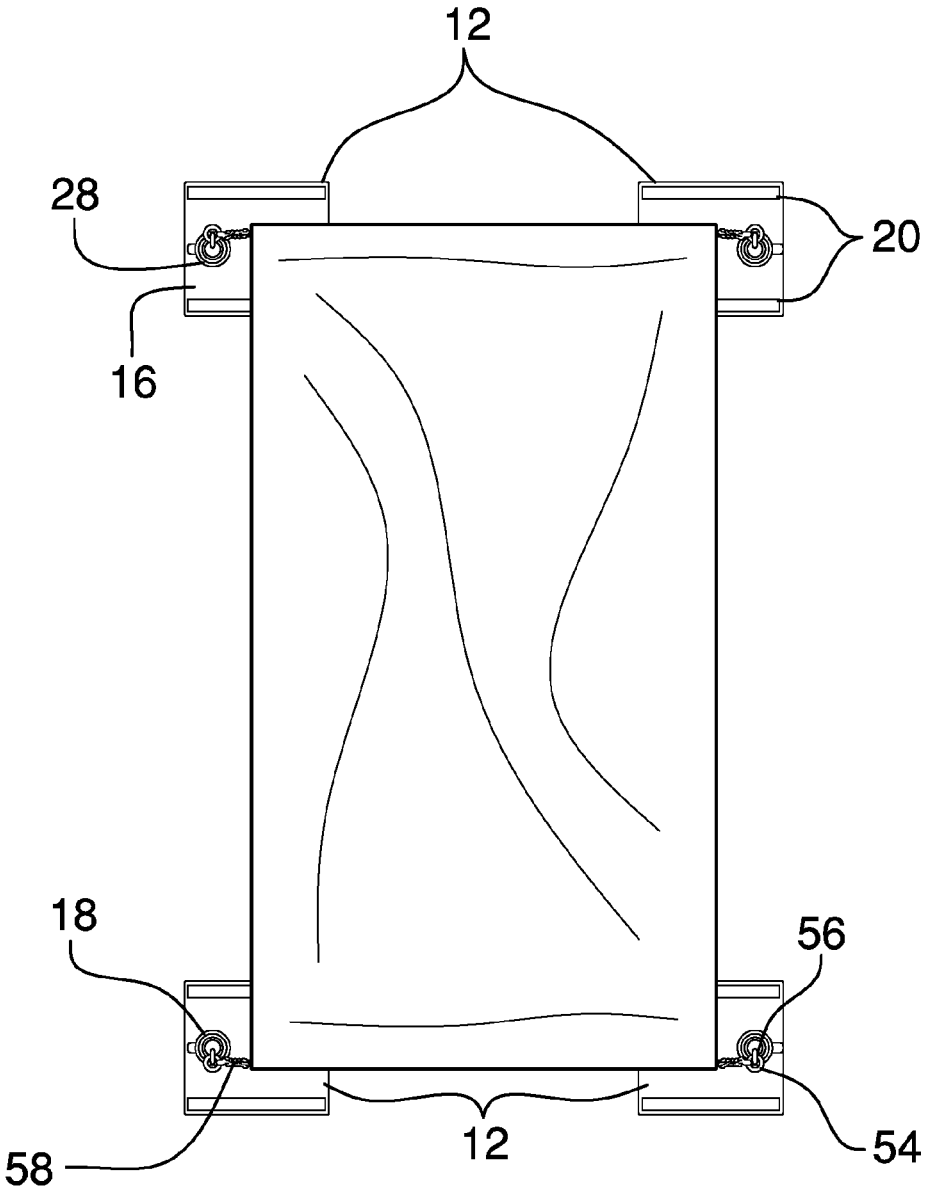
FIG. 4 is a top view of an embodiment of the disclosure.
Figure 5:
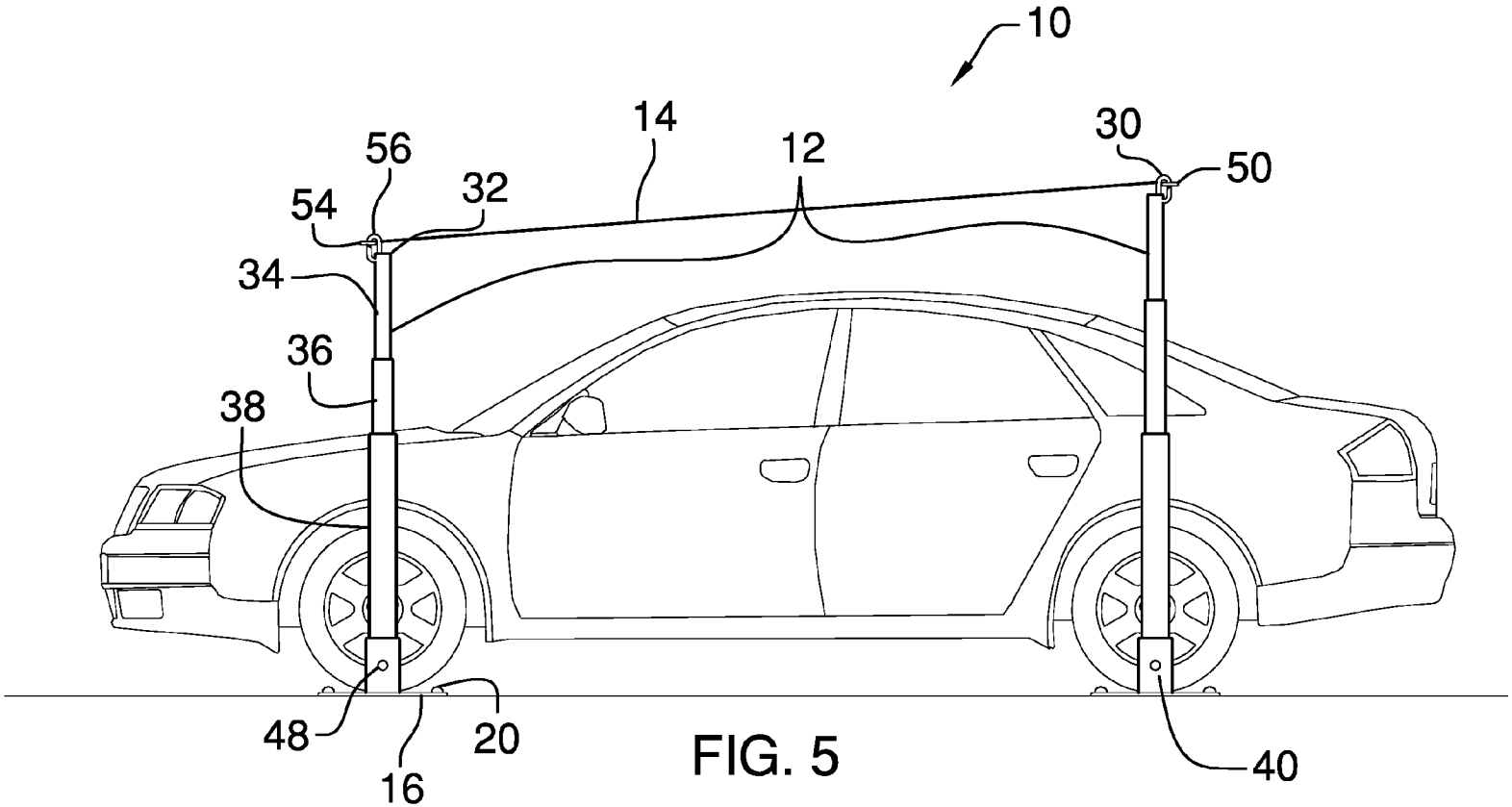
FIG. 5 is an in-use view of an embodiment of the disclosure.

With reference now to the drawings, and in particular to FIGS. 1 through 5 thereof, a new sheltering assembly embodying the principles and concepts of an embodiment of the disclosure and generally designated by the reference numeral 10 will be described.

As best illustrated in FIGS. 1 through 5, the deployable sheltering assembly 10 generally comprises a set of four supports 12 and a panel 14, which is flexible. Each support 12 comprises a plate 16 and a rod 18. The plate 16 is configured to position under a respective wheel of a vehicle. In one embodiment, the plate 16 is substantially rectangularly shaped. In another embodiment, each of a pair of extrusions 20 is coupled to and extends from an upper face 22 of the plate 16. Each extrusion 20 extends longitudinally between opposing ends 24 of the plate 16 proximate to a respective opposing side 26 of the plate 16. The extrusions 20 are configured to indicate to a user that the respective wheel of the vehicle is positioned on the plate 16. In yet another embodiment, the extrusions 20 are arcuate. In still yet another embodiment, the panel 14 is substantially rectangularly shaped.

The rod 18 is coupled to and extends perpendicularly from the plate 16. The rod 18 comprises a plurality of nested sections 28 and is selectively extensible. A first coupler 30 is coupled to a top 32 of the rod 18. The rod 18 is configured to extend from the plate 16 adjacent to a side of the vehicle so that the top 32 of the rod 18 is positioned above the vehicle. In one embodiment, the plurality of nested sections 28 comprises an upper segment 34, a medial segment 36 and a lower segment 38. In another embodiment, the rod 18 is positioned proximate to a respective opposing end 24 of the plate 16. In yet another embodiment, the rod 18 is positioned substantially equally distant from the opposing sides 26 of the plate 16. In still yet another embodiment, the rod 18 is substantially circularly shaped when viewed longitudinally.

In one embodiment, the rod 18 is reversibly couplable to the plate 16. The rod 18 and the plate 16 are separable to be stowed when not in use. A tube 40 is coupled to and extends perpendicularly from the plate 16. The tube 40 is complementary to the lower segment 38 of the rod 18. The tube 40 is positioned to reversibly insert the rod 18 to couple the rod 18 to the plate 16. In another embodiment, a first fastener 42 is coupled to the lower segment 38 of the rod 18. A second fastener 44 is coupled to the tube 40. The second fastener 44 is complementary to the first fastener 42. The second fastener 44 is positioned to couple to the first fastener 42 to couple the rod 18 to the tube 40. In yet another embodiment, the second fastener 44 comprises a hole 46 and the first fastener 42 comprises a pin 48. The pin 48 is spring-loaded and complementary to the hole 46. The hole 46 is positioned to insert the pin 48 to couple the rod 18 to the tube 40.

Each of a set of four second couplers 50 is coupled to the panel 14 proximate to a respective corner 52 of the panel 14. The second couplers 50 are complementary to the first couplers 30. Each second coupler 50 is positioned to couple to a respective first coupler 30 to couple the panel 14 to the supports 12. The panel 14 is configured to shelter the vehicle. In one embodiment, the second couplers 50 comprise grommets 54 and the first couplers 30 comprises carabiners 56. In another embodiment, each of a set of four cords 58 is coupled to and extends between a respective corner 52 of the panel 14 and an associated grommet 54. Each cord 58 is positioned so that an associated grommet 54 is positioned to couple to a respective carabiner 56 to couple the panel 14 to the supports 12. In yet another embodiment, the cords 58 comprise elastic.

In use, the hole 46 is positioned to insert the pin 48 to couple the rod 18 to the tube 40. The rod 18 is configured to extend from the plate 16 adjacent to the side of the vehicle. The top 32 of the rod 18 is positioned above the vehicle. The plates 16 are configured to position singly under the wheels of the vehicle. The supports 12 are positioned singly proximate to each wheel of the vehicle. The extrusions 20 are configured to indicate to the user that the wheel of the vehicle is positioned on the plate 16. Each grommet 54 is positioned to couple to a respective carabiner 56 to couple the panel 14 to the supports 12. The panel 14 is configured to shelter the vehicle.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A deployable sheltering assembly comprising:

a set of four supports, each said support comprising:

a plate configured for positioning under a respective wheel of a vehicle, a rod coupled to and extending perpendicularly from said plate, said rod comprising a plurality of nested sections such that said rod is selectively extensible, wherein said rod is positioned on said plate such that said rod is configured for extending from said plate adjacent to a side of the vehicle such that a top of said rod is positioned above the vehicle, and a first coupler coupled to said top of said rod, said first coupler being a carabiner having a longitudinal side extending upwardly from said top of said rod parallel to a longitudinal axis of said rod, said carabiner having a lower arcuate end inset into said rod wherein said lower arcuate end extends laterally outward from said rod adjacent to said top end whereby said carabiner is in a fixed position relative to said rod;

a panel, said panel being flexible;

a set of four second couplers, said second couplers being complementary to said first couplers, each said second coupler being coupled to said panel proximate to a respective corner of said panel; and wherein said plates are configured for positioning singly under the wheels of the vehicle such that said supports are positioned singly proximate to each wheel of the vehicle, wherein said second couplers are positioned on said panel such that each said second coupler is positioned for coupling to a respective said first coupler to couple said panel to said supports such that said panel is configured for sheltering the vehicle.

2. The assembly of claim 1, further including said plates being substantially rectangularly shaped.

3. The assembly of claim 1, further including a pair of extrusions, said extrusion being coupled to and extending from an upper face of said plate, each said extrusion extending longitudinally between opposing ends of said plate proximate to a respective opposing side of said plate, wherein said extrusions are positioned on said plate such that said extrusions are configured for indicating to a user that the respective wheel of the vehicle is positioned on said plate.

4. The assembly of claim 3, further including said extrusions being arcuate.

5. The assembly of claim 1 further including said rod being positioned proximate to a respective opposing end of said plate.

6. The assembly of claim 1, further including said rod being positioned substantially equally distant from opposing sides of said plate.

7. The assembly of claim 1, further including said rod being substantially circularly shaped when viewed longitudinally.

8. The assembly of claim 1, further including said rod being removably couplable to said plate such that said rod and said plate are separable for stowing when not in use.

9. The assembly of claim 8, further including said plurality of nested sections comprising an upper segment, a medial segment and a lower segment.

10. The assembly of claim 9, further including a tube coupled to and extending perpendicularly from said plate, said tube being complementary to said lower segment of said rod such that said tube is positioned for reversibly inserting said rod to couple said rod to said plate.

11. The assembly of claim 10, further comprising:

a first fastener coupled to said lower segment of said rod;

a second fastener coupled to said tube, said second fastener being complementary to said first fastener; and wherein said second fastener is positioned on said tube such that said second fastener is positioned for coupling to said first fastener to couple said rod to said tube.

12. The assembly of claim 11, further including said second fastener comprising a hole, said first fastener comprising a pin, said pin being spring-loaded, said pin being complementary to said hole, wherein said hole is positioned in said tube such that said hole is positioned for inserting said pin to couple said rod to said tube.

13. The assembly of claim 1, further including said panel being substantially rectangularly shaped.

14. The assembly of claim 1, further including said second couplers comprising grommets.

15. The assembly of claim 14, further including a set of four cords, each said cord being coupled to and extending between a respective said corner of said panel and an associated said grommet, wherein said cords are positioned on said panel such that each said cord is positioned for positioning an associated said grommet for coupling to a respective said carabiner to couple said panel to said supports.

16. The assembly of claim 15, further including said cords comprising elastic.

17. A deployable sheltering assembly comprising:

a set of four supports, each said support comprising:

a plate configured for positioning under a respective wheel of a vehicle, said plate being substantially rectangularly shaped, a pair of extrusions, said extrusion being coupled to and extending from an upper face of said plate, each said extrusion extending longitudinally between opposing ends of said plate proximate to a respective opposing side of said plate, wherein said extrusions are positioned on said plate such that said extrusions are configured for indicating to a user that a wheel of the respective vehicle is positioned on said plate, said extrusions being arcuate, a rod coupled to and extending perpendicularly from said plate, said rod comprising a plurality of nested sections such that said rod is selectively extensible, wherein said rod is positioned on said plate such that said rod is configured for extending from said plate adjacent to a side of the vehicle such that a top of said rod is positioned above the vehicle, said plurality of nested sections comprising an upper segment, a medial segment and a lower segment, said rod being positioned proximate to a respective said opposing end of said plate, said rod being positioned substantially equally distant from said opposing sides of said plate, said rod being substantially circularly shaped when viewed longitudinally, said rod being removably couplable to said plate such that said rod and said plate are separable for stowing when not in use, a tube coupled to and extending perpendicularly from said plate, said tube being complementary to said lower segment of said rod such that said tube is positioned for reversibly inserting said rod to couple said rod to said plate, a first fastener coupled to said lower segment of said rod, a second fastener coupled to said tube, said second fastener being complementary to said first fastener, wherein said second fastener is positioned on said tube such that said second fastener is positioned for coupling to said first fastener to couple said rod to said tube, said second fastener comprising a hole, said first fastener comprising a pin, said pin being spring-loaded, said pin being complementary to said hole, wherein said hole is positioned in said tube such that said hole is positioned for inserting said pin to couple said rod to said tube, and a first coupler coupled to said top of said rod, said first coupler being a carabiner having a longitudinal side extending upwardly from said top of said rod parallel to a longitudinal axis of said rod, said carabiner having a lower arcuate end inset into said rod wherein said lower arcuate end extends laterally outward from said rod adjacent to said top end whereby said carabiner is in a fixed position relative to said rod;

a panel, said panel being flexible, said panel being substantially rectangularly shaped;

a set of four second couplers, said second couplers being complementary to said first couplers, each said second coupler being coupled to said panel proximate to a respective corner of said panel, wherein said second couplers are positioned on said panel such that each said second coupler is positioned for coupling to a respective said first coupler to couple said panel to said supports such that said panel is configured for sheltering the vehicle, said second couplers comprising grommets;

a set of four cords, each said cord being coupled to and extending between a respective said corner of said panel and an associated said grommet, wherein said cords are positioned on said panel such that each said cord is positioned for positioning an associated said grommet for coupling to a respective said carabiner to couple said panel to said supports, said cords comprising elastic; and wherein said hole is positioned in said tube such that said hole is positioned for inserting said pin to couple said rod to said tube, wherein said rod is positioned on said plate such that said rod is configured for extending from said plate adjacent to the side of the vehicle such that said top of said rod is positioned above the vehicle, wherein said plates are configured for positioning singly under the wheels of the vehicle such that said supports are positioned singly proximate to each wheel of the vehicle, wherein said extrusions are positioned on said plate such that said extrusions are configured for indicating to the user that the wheel of the vehicle is positioned on said plate, wherein said grommets are positioned on said panel such that each said grommet is positioned for coupling to a respective said carabiner to couple said panel to said supports such that said panel is configured for sheltering the vehicle.

* * * * *